US005123131A

United States Patent [19]

Jandrakovic

[11] Patent Number: 5,123,131

[45] Date of Patent: Jun. 23, 1992

[54] CEILING MOUNTED PATIENT STANDING ASSISTANCE APPARATUS

[76] Inventor: Joyce A. Jandrakovic, 38630 Calumet Ave., Zephyrhills, Fla. 33540

[21] Appl. No.: 657,469

[22] Filed: Feb. 19, 1991

Related U.S. Application Data

[63] Continuation-in-part of Ser. No. 367,620, Jun. 19, 1989, Pat. No. 5,016,300.

[51] Int. Cl.[5] ..... A61G 7/10

[52] U.S. Cl. ..... 5/81.1; 414/921; 24/134 R; 297/DIG. 10; 254/391; 5/83.1; 5/89.1

[58] Field of Search ..... 414/592, 921; 4/564; 254/227, 334–338, 391, 394, 398, 399; 297/DIG. 10; 5/81 R, 81 B, 83, 84, 87, 88, 89; 24/134 R, 134 L, 132 R, 133, 128

[56] References Cited

U.S. PATENT DOCUMENTS

| | | | |
|---|---|---|---|
| 430,642 | 6/1890 | Hale | 5/87 |
| 595,514 | 12/1897 | Attkisson . | |
| 649,901 | 5/1900 | Brennan | 24/134 R |
| 983,957 | 2/1911 | Trantham | 254/338 |
| 1,103,823 | 7/1914 | Padgett et al. | 254/391 X |
| 1,385,427 | 7/1921 | Billings | 5/81 R |
| 1,971,294 | 8/1934 | Bunker | 5/81 B |
| 2,207,516 | 7/1940 | Ganke | 24/132 R X |
| 2,243,910 | 6/1941 | Laborda | 24/132 R |
| 2,386,137 | 10/1945 | Olsson et al. | 24/132 R X |
| 2,516,553 | 7/1950 | Cole | 4/564 X |
| 2,547,370 | 4/1951 | Boyer | 24/133 |
| 3,335,468 | 8/1967 | Harley | 24/128 R |
| 3,351,959 | 11/1967 | Turpin | 5/83 |
| 3,626,888 | 12/1971 | Cameron et al. | 24/134 R X |
| 4,117,561 | 10/1978 | Zamotin | 5/83 |
| 4,191,416 | 3/1980 | Nist | 5/81 R X |
| 4,194,253 | 3/1980 | Ullven | 5/84 |
| 4,243,147 | 1/1981 | Twitchell et al. | 212/159 |
| 4,600,177 | 7/1986 | Fritz | 254/338 |
| 4,606,082 | 8/1986 | Kuhlman | 4/561 |

FOREIGN PATENT DOCUMENTS

| | | | |
|---|---|---|---|
| 1133636 | 11/1968 | United Kingdom | 5/81 R |

*Primary Examiner*—David A. Bucci
*Assistant Examiner*—Robert S. Katz
*Attorney, Agent, or Firm*—Herbert W. Larson

[57] ABSTRACT

An invalid assistance device mounted on a ceiling is which a supported locked and guided flexible line is used to stabilize an invalid in the range of desired vertical positions from sitting to standing while a single attendant can work with the stabilized invalid.

5 Claims, 9 Drawing Sheets

CEILING MOUNTED PATIENT STANDING ASSISTANCE APPARATUS

PRIOR APPLICATION

This application is a continuation-in-part of my application Ser. No. 07/367,620, filed Jun. 19, 1989, now U.S. Pat. No. 5,016,300.

BACKGROUND OF THE INVENTION

The invention relates to nursing home devices, particularly those useful in facilitating assistance of invalid persons with day to day hygiene functions.

Many invalid persons suffer from incapacities of a nature which require the continuous assistance of a nurse or relative but do not pose the sort of medical concerns requiring continuous professional care or confinement to an institution. Many of these invalids are not able to walk or support themselves in an upright position. As such, it normally requires two or more persons to assist them with bowel movements, scrub bathing, and baths or showers. The ability to support the invalid in an upright position, while leaving both hands free to work with the invalid, would permit such an invalid to be adequately attended by one person.

A number of devices exist to provide invalid lifting and moving. One such device is disclosed in U.S. Pat. No. 2,516,553, issued to Cole on Dec. 29, 1986. It comprises a frame on casters equipped with an overhead member and a harness, which is in communication with a power or manual winch through a pulley guided cable. With this device a patient is lifted out of a wheelchair or bed and moved from one place to another by rolling the device on its casters.

Another such device is U.S. Pat. No. 4,530,122, issued to Sanders, et al. on Jul. 23, 1985, which discloses, generally, a body sling attached to two rigid supports, such supports being affixed to a pivotal overhead member. By rotating the overhead member, the patient may be lifted or supported in a variety of positions from the bed or wheelchair upon which the apparatus is mounted. As in Cole the lifting of the patient ma be accomplished via power assists from a motor-driven or hand crank winch-type device.

U.S. Pat. No. 1,103,436, issued to Root on Jul. 14, 1914, discloses another patient lift device. It comprises a body sling raised or lowered by cable and pulley from an overhead member. The patient is raised or lowered in a sitting position again with power assistance from a winch-type mechanism.

U.S. Pat. No. 885,307, issued to Whaley on Apr. 21, 1908, teaches a tripod for permanent installation over a patient's bed. It permits a patient to be lifted up from the bed or supported in the upright position. Because of its dependence on permanent attachments to the bed, it does not have the potential to assist an invalid in other locations.

U.S. Pat. No. 1,059,815, issued to Belles on Apr. 22, 1918, teaches a four legged frame, on casters, with a suspending horizontal arc and a full body harness. It permits a patient to be winched up from a bed and rolled to a desired location on casters. Because of its bulk, the device taught in Belles could not be used in small areas.

There have been a number of other devices, disclosed for assisting in the movement and handling of invalids. To date however, each such device comprises a relatively elaborate structure and is equipped to lift or stabilize a patient in a given orientation. These devices do not have the simplicity, versatility, or maneuverability required for a variety of hygiene functions and location. What is needed is a simple device enabling one person to quickly support the invalid in a desired position. It would also be helpful to have such a device which can be moved to a variety of desired locations.

SUMMARY OF THE INVENTION

Apparatus is disclosed which permits the stabilizing of an invalid at virtually any desirable upright position from sitting through a full standing position. The apparatus includes a vertically suspended padded harness, adapted to support an invalid across either the back or shoulder and under the arms, and which is in communication with a locking device through a flexible line, such as a cable or rope.

The apparatus may be suspended from a lightweight portable structure, or it may be suspended from a more permanently affixed structure, such as a frame fastened to a wall near the desired location.

The theory of operation in either case is similar. The harness is positioned on the invalid by slipping it around the invalid's arms and then over the invalid's head. This ensures a snug fit and prevents the likelihood that the invalid may inadvertently fall out of the harness.

The flexible line from the harness passes through a vertical suspension point, comprising an eye, a pulley, or the like, and then through a line locking means. An example of such line locking means is the Morelan Mfg. Co., "NEVERSLIP . . . ANCHOR ROPE LOCK". This device permits a rope to be alternately passed through the device or instantaneously locked into position by the attendant or operator, with only one hand. When in the locked position, the invalid's full weight is supported by the apparatus.

Since the invalid envisioned by this device is capable of some self-help, the attendant initially assists the invalid in achieving the desired position by the attendant and then the invalid is released. The locking device automatically locks the line into place and supports the invalid while cleaning or other assistance is rendered. It should be noted, however, that this device would also be useful and capable of assisting an invalid with no capacity for sitting or standing whatsoever. While two persons may initially be required to insert the invalid into the device, once inserted a single attendant would have both hands free to work with the invalid.

When the operation is completed, the line is again released by pulling it through the locking device from the opposite side of the lock from the invalid. The invalid is then allowed to resume the sitting or lying position and the harness can be removed.

A portable model of the stabilizing unit is also taught. It comprises a vertical support member comprising an upper support member which is mounted on a collapsible tripod assembly. The line locking mechanism is mounted on one of the three tripod legs, which may be connected by support rods at an appropriate level. The vertical support guide or pulley is suspended from the upper support member.

The entire apparatus may be folded and easily moved in order to provide support from the precise vertical location. Two support rods may be used to connect the tripod legs in such a manner as to permit one opening between two given tripod legs in order to facilitate access by the invalid as may be necessary to perform a given operation and to facilitate positioning of the tripod over an appliance, such as a toilet, sink, or chair. Near the top of the tripod a chain may be fixed to surround the tripod legs. This gives the device stability in a desired orientation by holding the legs firm, even when the area in which the device is to be used is small such as in a small bathroom.

In one permanently installed version of the stabilizing unit, an upper support member is fixed to the wall so as to extend above the desired location. This upper support member is supported by either an upright member from the floor or fixed to the wall and an angled support beam back to the wall from the distant end of the upper support member. In another permanently installed version, an upper support member may be affixed to suspend from a ceiling joist without further need for support.

The vertical support guide (pulley or eyelets) is then attached to the upper support member. Additional line guide members are placed as needed along the upper support member and support members to permit the line locking device to be placed in an appropriate position.

It is noted that as many line guide means may be placed as needed to permit precise location of the suspended harness as well as convenient location of the line locking means. It should also be noted that the line locking means need not, in either described application, be fixed to part of the harness support structure, but may be mounted upon any suitable and adequately rigid object proximate to the desired location. It is the object of the present invention to provide an apparatus for stabilizing an invalid.

It is a further object of the invention to provide a means of providing the "hands-free" stabilizing of an invalid in a variety of desirable upright positions, such as at the toilet, the sink, or in the shower, so that the invalid may be adequately tended by one nurse or attendant.

It is further object of the invention to provide a portable apparatus to assist the handling of invalids in a variety of locations.

Other features and advantages of the present invention will be apparent from the following description in which the preferred embodiments have been set forth in conjunction with the accompanying drawings.

DETAILED DESCRIPTION OF THE PREFERRED EMBODIMENTS

Figure 1:
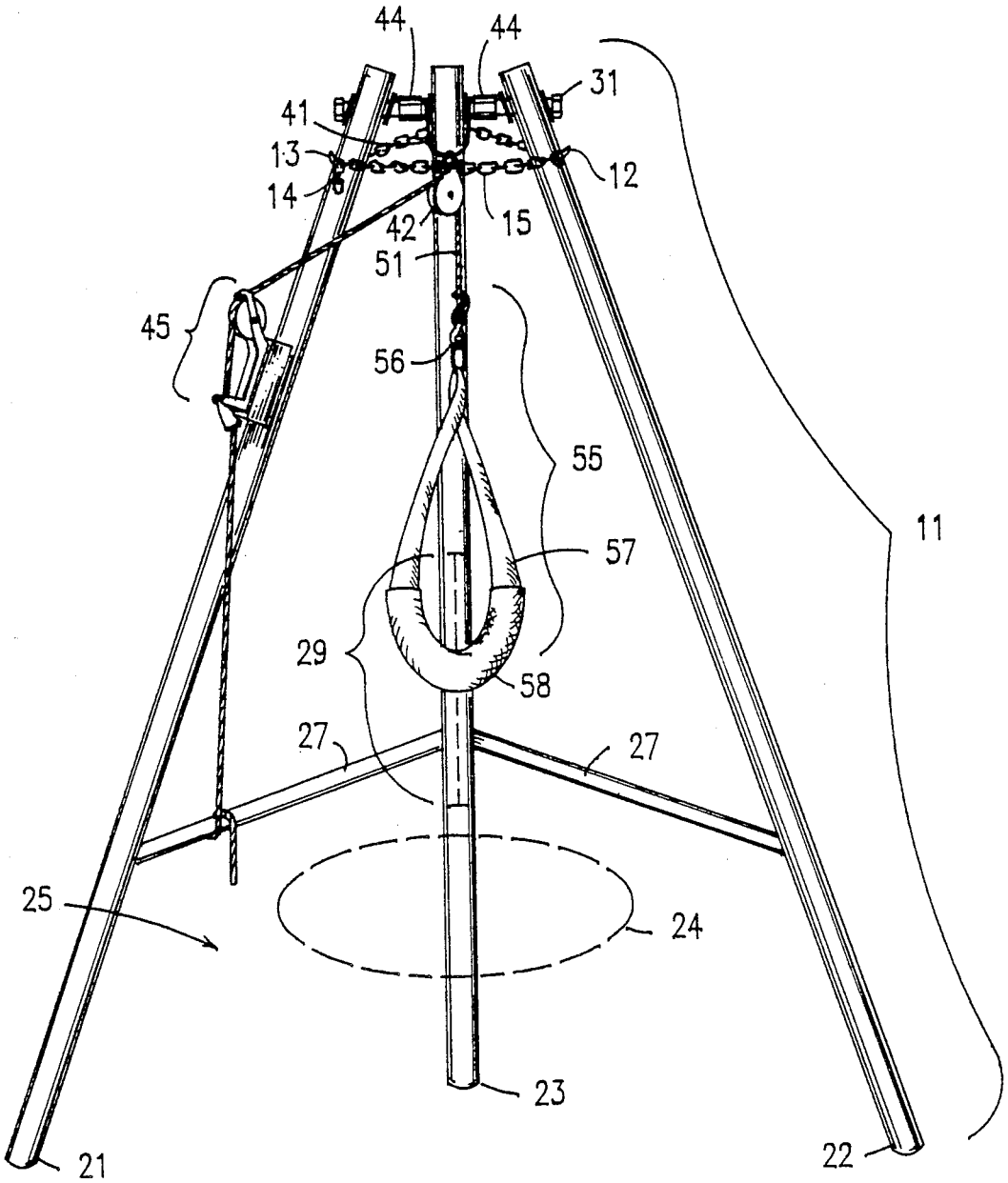
FIG. 1 depicts the portable apparatus.

The invalid support apparatus of the present invention is shown in its various configurations in the figures. FIG. 1 depicts the collapsible tripod mounted system, which offers the advantage of mobility in that the system may be delivered where needed.

Making reference to FIG. 1, the collapsible tripod system 11 is described as follows. Three legs 21, 22 and 23 provide support for the system. Legs 21 and 22 are the left and right outer legs, respectively, and are detachably connected to the center leg 23 which becomes the rear leg in use by support members 27.

The three legs 21, 22 and 23 are also connected at the top by pivot bolt 31 about which the legs 21, 22 and 23 may pivot as required. From pivot bolt 31 is also a pivotally mounted support 41 for a center pulley 42 through which a flexible line, or cable 51 may be passed. Separators 44 are placed appropriately in order to permit the pivoting legs 21, 22 and 23 and pivoting support 41 to freely pivot without mutual interference.

Together, the support members 27 and the three tripod legs 21 22 and 23 define a tripod enclosed space 24 which is open on one side 25. This open side 25 permits the tripod system 11 to be easily position, by sliding, so that its pivot bolt 31 and center pulley 42 are directly above a toilet 72, FIG. 3, or other desired fixture or area. The open side 25 further facilitates the entry and exit of the invalid to and from the tripod enclosed space 24.

Additionally, near the top of the tripod system 11 are provided means for stabilizing the device. Each tripod leg 21, 22 and 23 is adapted with an outward extending hook 12, 13 which can receive a desired link 14 of a chain 15. At least one hook 13 is large enough to receive two links 14 of the chain 15. Accordingly, the chain 15 may be positioned around the tripod legs 21, 22 and 23 by placing the desired link 14 within each hook 12, 13 so that the expansion of the tripod system 11 is regulated and stabilized.

Attached to said cable 51 at an end suspended from said center pulley 42 is a harness apparatus 55 comprising a means 56 for connecting said harness apparatus 55 to said cable 51 and a harness loop 57 adapted with a padded sleeve 58.

Figure 2:
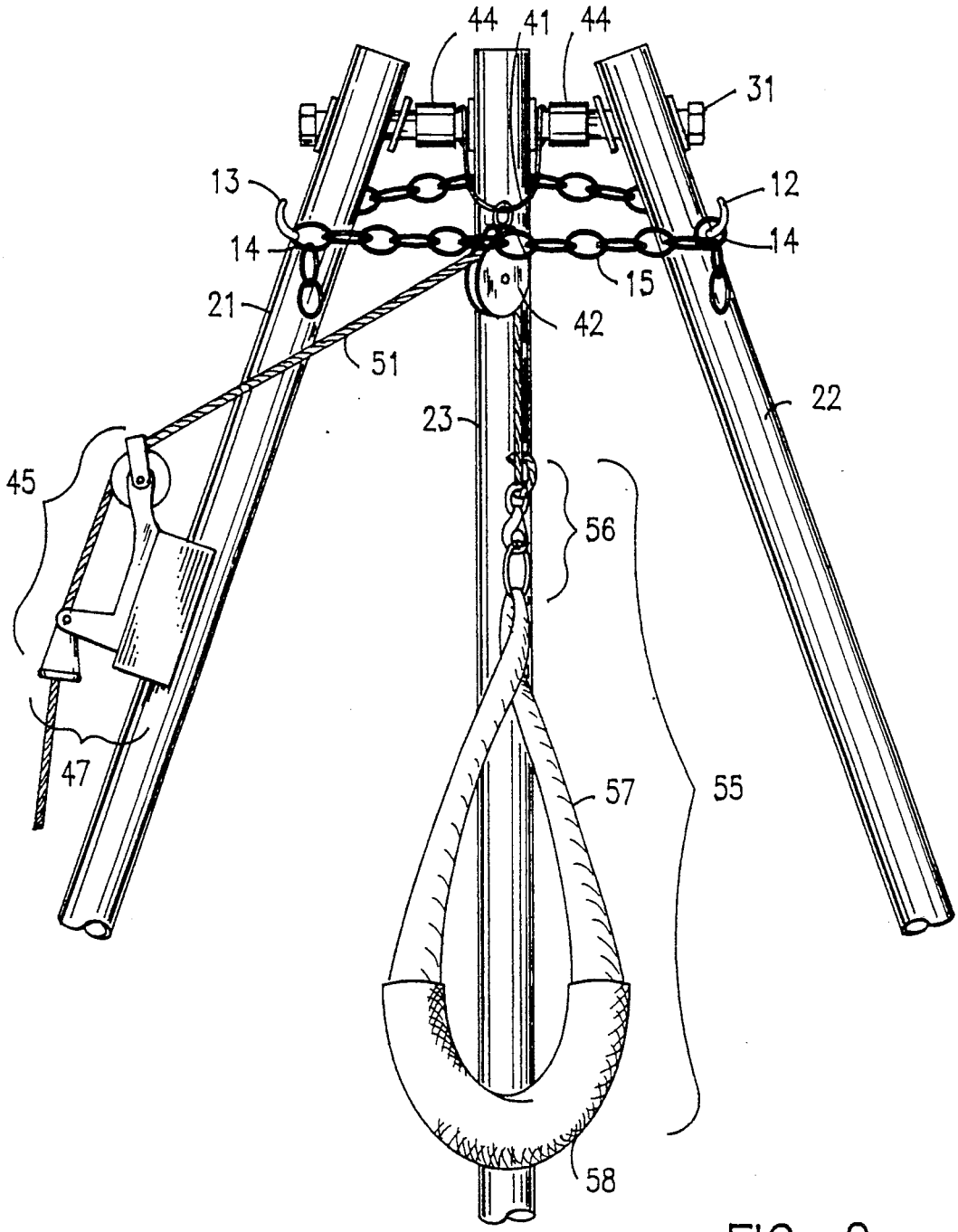
FIG. 2 depicts the upper portion of the portable apparatus, detailing the pulley and chain stabilizer.

Making reference now to FIG. 2, on which is a provided detailed view of the pivot bolt 31 apparatus with pulley 42 and support 41, the operation of the device can be better explained. Additionally, reference should be made to FIGS. 4A and 4B, which are expanded views of the cable locking means 45 and explain its operation as will be detailed later. The cable 51 is, from the harness apparatus 55, passed through the pulley 42 and from there through a cable locking mechanism 45, such as the "NEVERSLIP . . . ANCHOR ROPE LOCK" ®, more fully depicted in FIGS. 4A and 4B. This cable lock mechanism 45 permits the cable to pass freely through in the direction raising the harness apparatus 55 but said cable 51 may only pass through said locking mechanism 45 in a direction lowering said harness means 55 if the pivoting locking arm 96 is manually pulled into the position 47 from the locked position 48.

Reference is again made to FIG. 1. While the locking mechanism 45 is held in the open position 47 the cable 51 can pass freely through the pulley 42 and locking mechanism 45 so that the harness apparatus 55 may be raised or lowered to any desired level. If, however, the cable 51 is allowed to pass, unattended, through the locking mechanism 45, the pivoting locking arm line guide 96 will immediately assume the locked position 48 and the harness apparatus 55 will be locked in its position.

Figure 3:
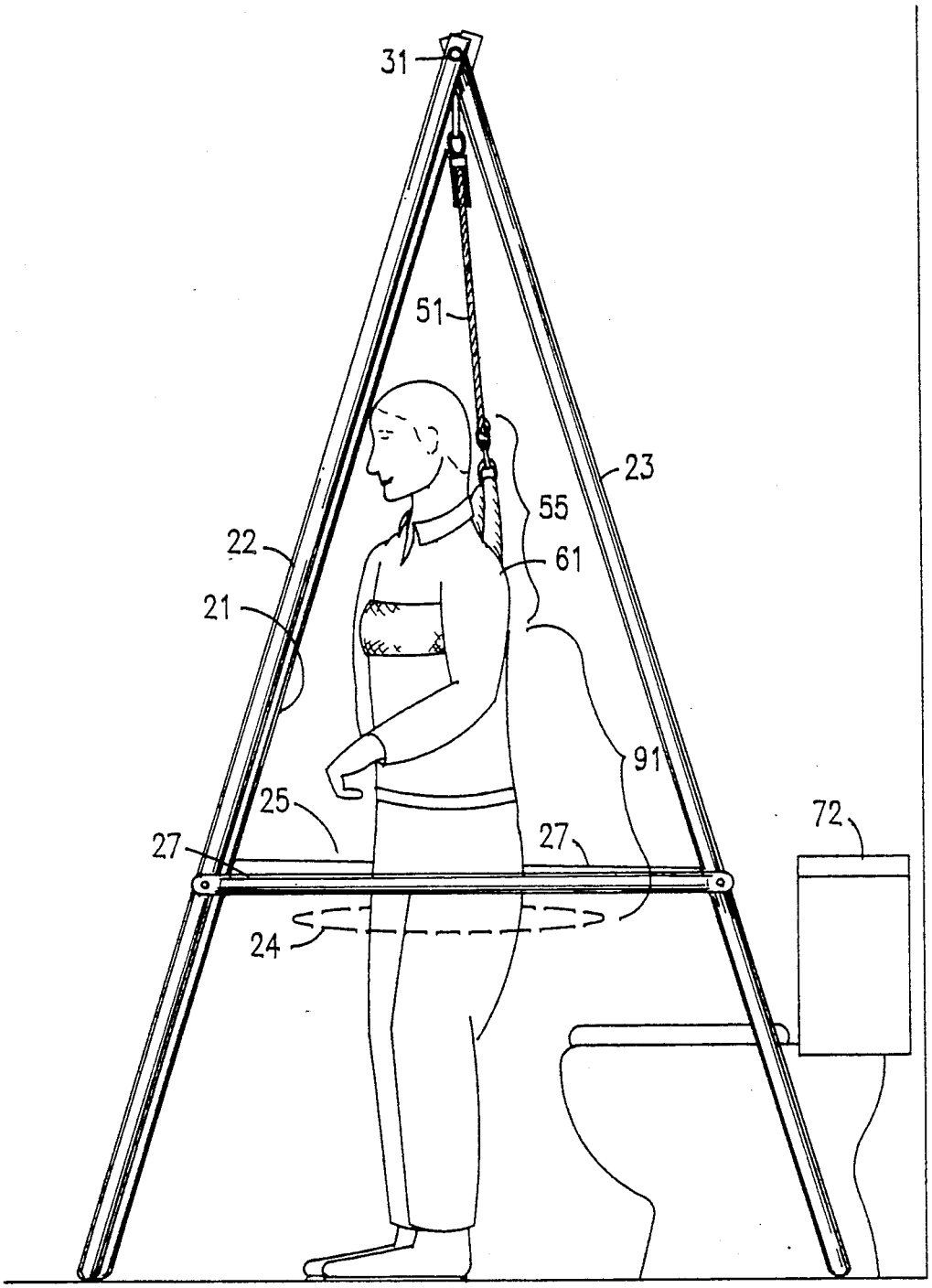
FIG. 3 depicts the preferred embodiment portable apparatus in which a person is being supported.

Making brief reference now to FIG. 3, an invalid person 61 can be inserted into the device by fitting the padded portion 58 of the harness apparatus 55 across their chest and under the arms of said invalid person 61. While the locking arm line guide 96 is in the locked position 48, the invalid will be held in the same position by the harness apparatus 55. An attendant will therefore be free to work with the invalid with both hands as the stabilizer holds the invalid upright.

If it becomes necessary to change the position of the invalid person 61, then the attendant may, with one hand, pull on the cable 51 in a manner so as to cause the locking arm line guide 96 to be held in the open position 47 while assisting the invalid person 61 to obtain the desired new position with the other hand. Upon achieving the desired new position, the cable 51 can be released by the attendant, permitting the locking arm line guide 96 to automatically assume the locked position 48. This will prevent any further motion of the cable 51 and hold the invalid person 61 into position.

Figure 4A:
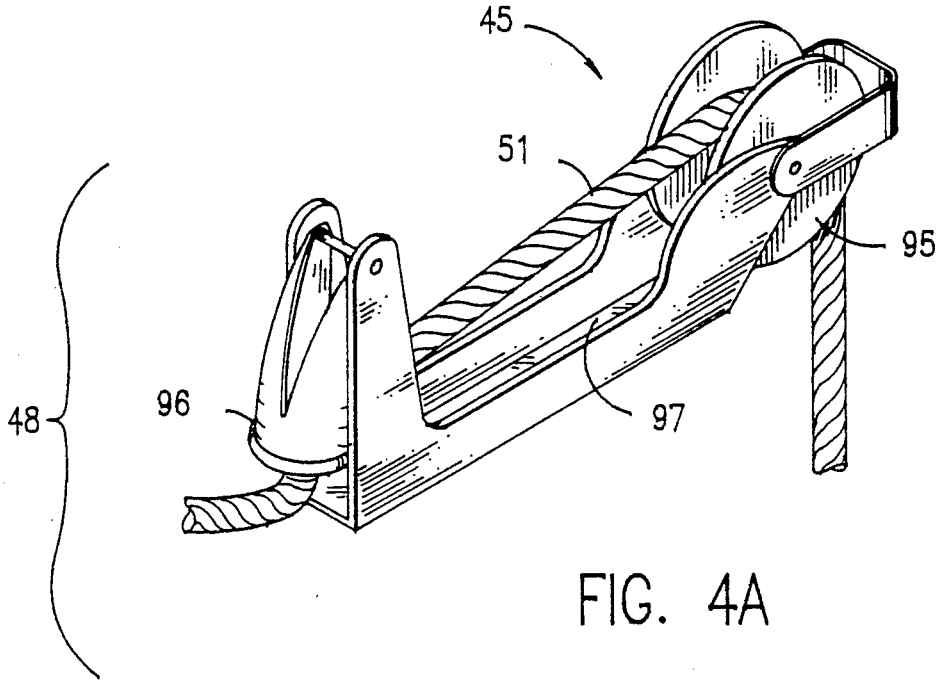
FIGS. 4A and 4B depict a means of locking the flexible line in the locked and open positions respectively..
Figure 4B:
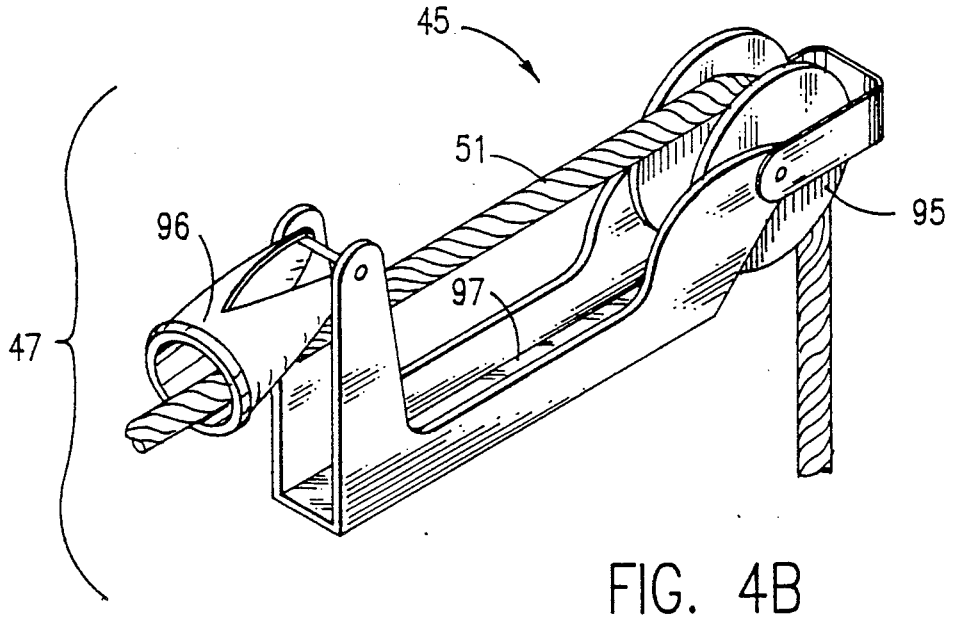

Referring now to FIGS. 4A and 4B a suitable line locking mechanism 45 is depicted. Such a device is available on the market and known as "NEVERSLIP . . . ANCHOR ROPE LOCK" ® by the Morelan Manufacturing Co. It comprises a bracket 97, a guiding pulley 95 and a pivotally mounted line guide 96 through which the flexible line 51 may be passed. When allowed to pivot freely and when the line is permitted to pass through the line guide 96 towards the pulley 95, the line guide 96 will be rotated towards the mounting bracket base 97 until the line guide 96 compresses the line 51 and locks the line 51 into place against the mounting bracket base 97. FIG. 4A depicts this apparatus in the locked position and FIG. 4B depicts the apparatus opened to permit the passage of the flexible line 51. In order to release the line 51, it is necessary only to pull up on the line 51 away from the mounting bracket base 97 so that the line 51 may freely pass through the line guide 96.

Figure 5:
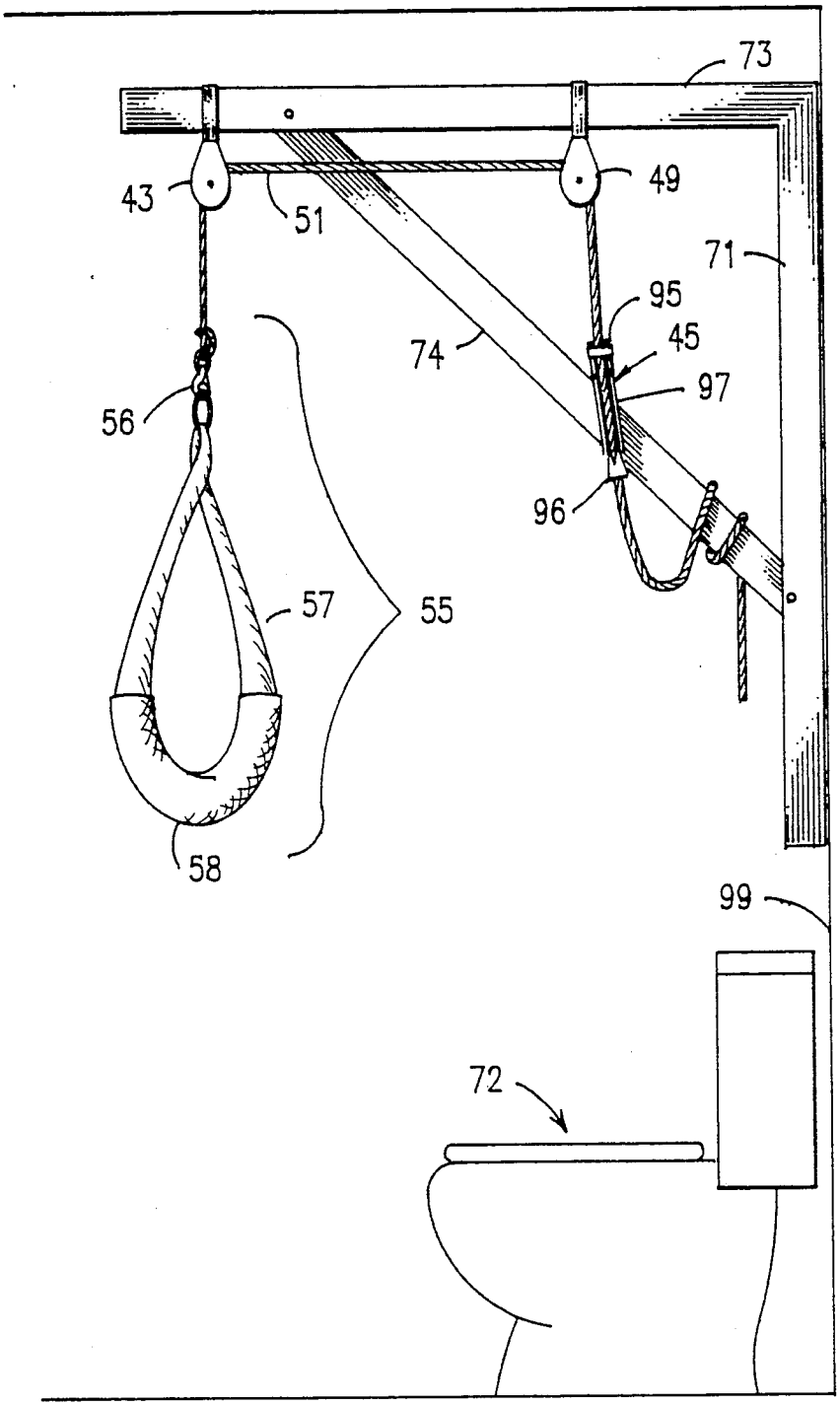
FIG. 5 depicts a version of the apparatus which is permanently mounted upon a wall.

An alternate embodiment of the device is depicted in FIG. 5. It depicts such an apparatus which has been mounted to a wall 99 and suspended above a toilet 72. In this embodiment, the center pulley 42 is replaced by first pulley 49 and second pulley 43 mounted to the horizontal arm 73 of the mounting frame 71 in order to permit the cable 51 to be directed through a useful path, such as over a toilet 72, (as depicted in FIG. 5) sink, or vanity (not depicted).

The locking mechanism (45) is now mounted upon a support brace 74 such that the cable 51 is easily within the reach of an attendant working with an invalid 61.

This alternative embodiment additionally demonstrates that any number of pulleys can be used in order to permit the cable 51 to be routed in the desired manner. Additionally, the pulleys could be replaced with another acceptable means for guiding the cable, or line, such as a shroud or eyelets.

Figure 6:
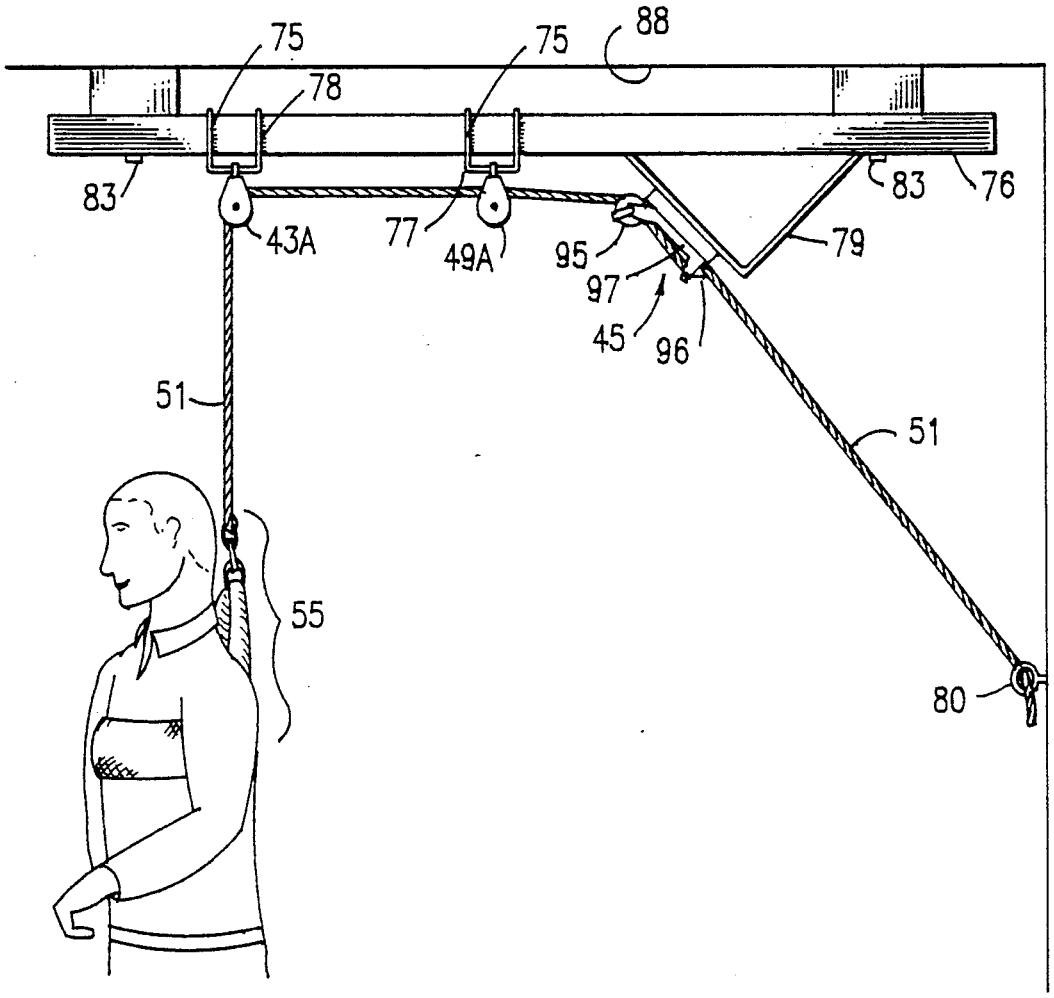
FIGS. 6 depicts a version of the apparatus which is permanently suspended from the ceiling.

A further alternate embodiment is depicted by FIG. 6. This embodiment is designed to make use of the existing room features for support and comprises a permanently fixed, single location embodiment of the invention.

In an example of this embodiment, bolts 83 are used to mount a support beam 76 to a ceiling 88. The pulleys 43A and 49A are fixed to the support beam 76 with pulley mounts 75 and placed at appropriate locations 77 and 78 along the beam 76, which is adapted with a mount 79 for the locking mechanism 45. The cable 51 is then directed from an invalid stabilization region to any convenient tie off location 80. In another form of this embodiment, pulley 43A could be fastened directly to the ceiling, much as a light fixture is installed. The locking mechanism 45 could be secured directly to a wall 99, FIG. 5, or a nearby sink or vanity (not depicted).

As demonstrated in the drawings, the cable 51 is directed from a beginning point of locking through one or more pulleys 43, 43A, 49 or 49A and is suspended from a pulley positioned above the stabilization area. The various pulleys are used to guide the cable 51 from a convenient locking point to a useful invalid stabilization region.

Figure 7B:
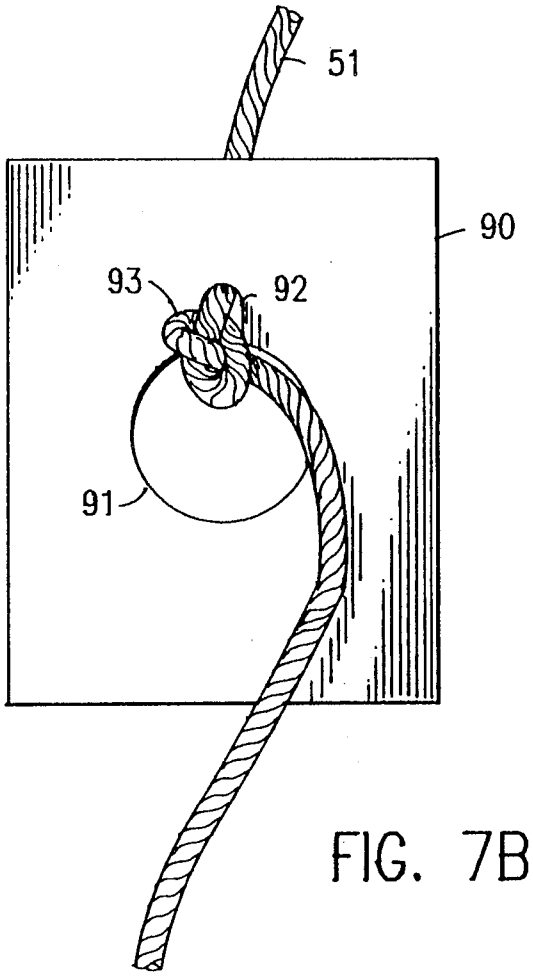
FIGS. 7A and 7B depict an alternative line locking apparatus.
Figure 7A:
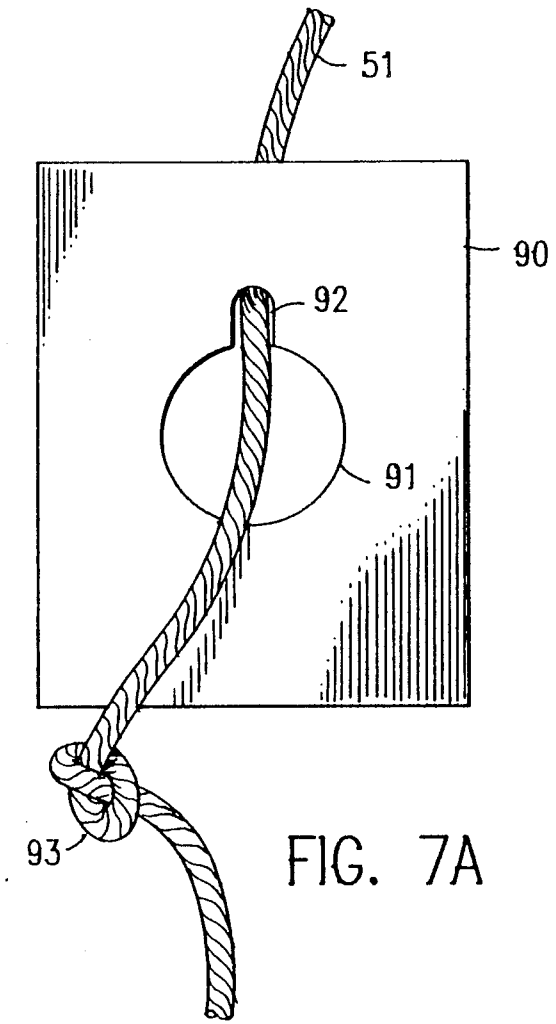

An alternative means of locking the line into place is depicted in FIGS. 7A and 7B. A bracket 90 comprising an opening 91 with a notch 92 is depicted. The opening 91 is of adequate diameter to permit the easy passage of the flexible line 51 in which a knot 93 has been tied as shown in FIG. 7A. The notch 92 however, is of adequate diameter to permit the passage of only the flexible line 51 without the knot 93, as shown in FIG. 7B. by mounting the bracket to a suitable position on the support means (not depicted in FIGS. 7A or 7B) such that the notch 92 is above the opening 91 the line 51 can be locked into position at the knot 93 and held there by the weight of the invalid.

It is also possible to consider the stabilizing chain 15 alone as sufficient to stabilize the tripod system 11 without the support members 27. The use of both the chain 15 and the support members 27 is depicted in FIGS. 1 through 3. The use of the stabilizing chain 15 alone offers the advantages of leaving all paths between the tripod legs 21, 22 and 23 open while providing stabilization from all sides. The optional use of the support members 27 may offer an invalid person an additional means of support as well as providing the apparatus with additional stability.

Figure 8A:
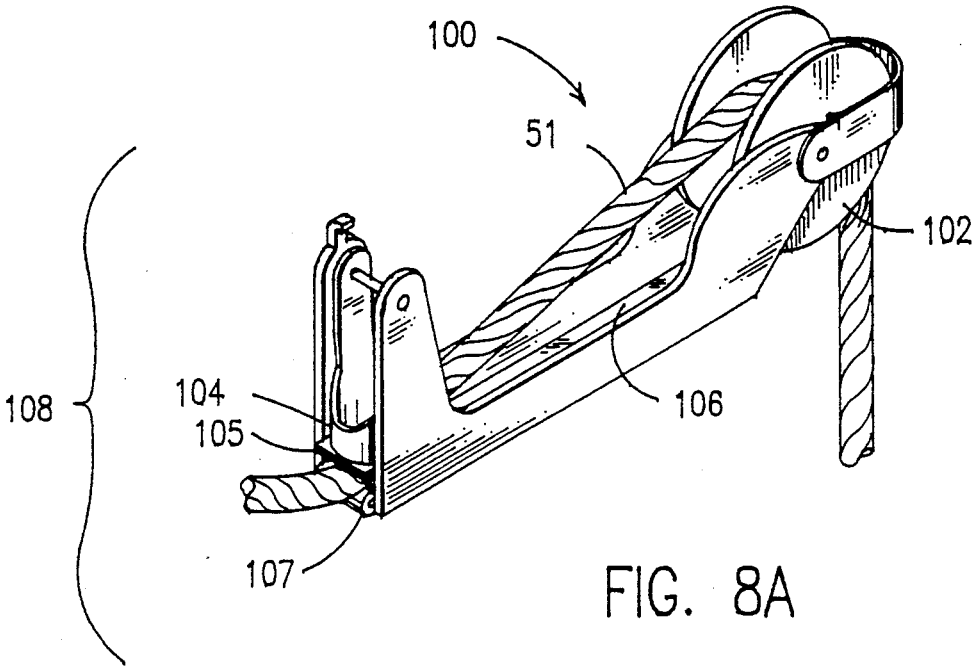
FIGS. 8A and 8B depict another alternative line locking apparatus in the locked and open positions respectively.
Figure 8B:
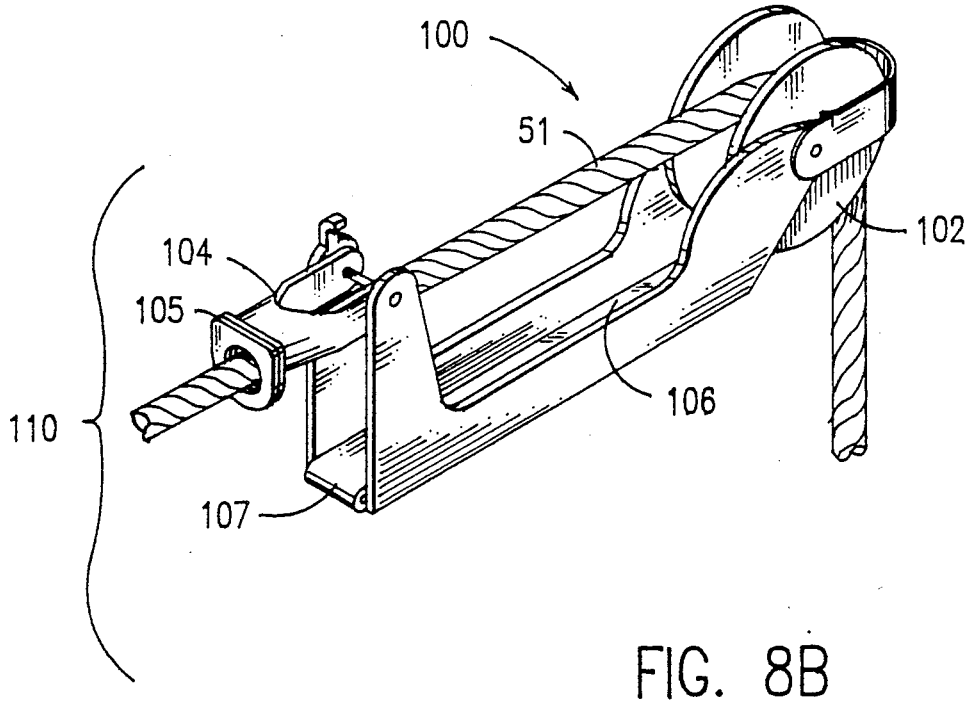

A further alternative locking mechanism 100 for the line 51 is set forth in FIGS. 8A and 8B. The locking mechanism 100 has a forward roller 102 supported on a frame member 106. A pivoting line guide 104 is supported at the rear of frame member 106. In the free running position 8B, the line guide 104 interior channel 103 is co-axial with line 51. In the locked position 8A the line guide 104 squeezes line 51 between end plates 105 and the interior base 107 of frame 106. The line 51 is locked in position whenever the attendant allows slack to occur in line 51 within frame 106.

Figure 9:
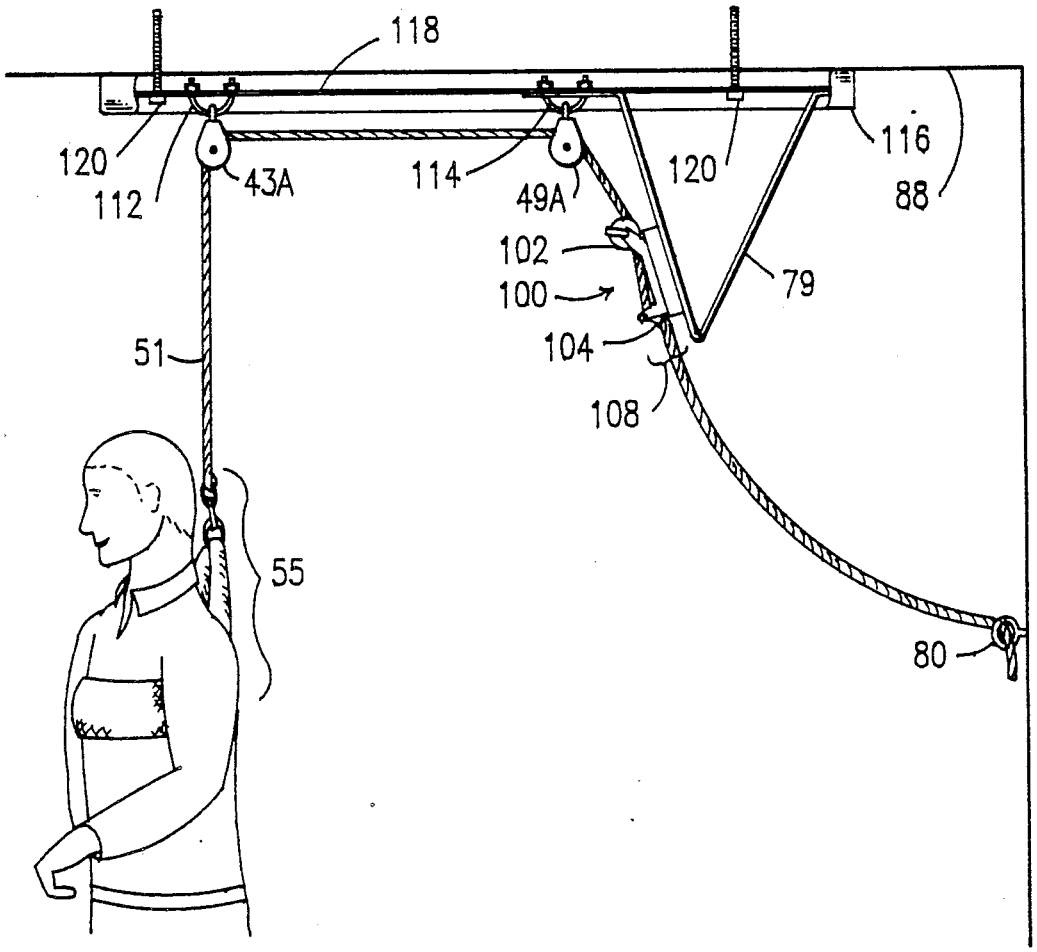
FIG. 9 is a preferred permanent ceiling mount.

In an alternative ceiling mount seen in FIG. 9, a ceiling mounted "H" frame 116 is bolted to a ceiling by bolts 120, through a horizontal portion 118 of the "h" frame 116. The horizontal portion 118 of the "H" frame supports a pair of crescent mounting brackets 112 and 114. These brackets in turn support pulleys 43B and 49A respectively. A triangular mounting brace 79 is also bolted to the "H" frame horizontal portion 118 by through bolts. Mounting brace 79 supports the locking mechanism 100.

The line locking mechanism 100 shown in FIG. 9 is locked 108 on line 51 as shown in FIG. 8A. The second end of line 51 is draped through ring 80. The first end of line 51 is attached to harness 55. To release the line an attendant merely needs to pull on the line 51 proximal to its second end.

Modification and variation can be made to the disclosed embodiments without departing from the subject and spirit of the invention as defined in the following claims. Such modifications and variations, as included within the scope of these claims are meant to be considered part of the invention a described.

Having thus described the invention, what is claimed and desired to be secured by Letters Patent is:

1. A ceiling mounted apparatus for supporting an invalid person in a sitting or standing position, the apparatus comprising, a longitudinal frame member attached to a ceiling, a mounting bracket descending below the longitudinal frame member for a locking mechanism attached proximal to a first end of the longitudinal frame member, a first pulley fixedly attached to the longitudinal frame member at a position proximal to the mounting bracket but distal from the first end of the longitudinal frame member and a second pulley attached fixedly to the longitudinal frame member at a position distal from the mounting bracket, and proximal to a second end of the longitudinal frame member, each pulley descending below the longitudinal frame member, a flexible line continuously threaded through both pulleys, the flexible line being of adequate strength to support an invalid person, a front end of the flexible line threaded beyond the second pulley attached to a connecting device, a padded loop for passing over the torso of an invalid person, the padded loop having an upper portion engaged to the connecting device, a line locking hand manipulated mechanism attached to the mounting bracket at a point on the flexible line between a second end of the flexible line and the first pulley, and the line locking hand manipulated mechanism allowing the flexible line to pass freely when the flexible line is pulled downward by an attendant for the invalid person, but stopping the flexible line from moving towards the first pulley when the second end of the flexible line is released by the attendant so that the invalid can be suspended by the padded loop and the attendant can have the freedom to administer to the invalid without holding the flexible line in place.

2. The ceiling mounted apparatus according to claim 1 wherein the line locking mechanism has a cylindrically shaped pivotably mounted line guide on a first end and a pulley at a second end, the line guide having an annular opening at a first end and a notch at a second end to engage the flexible line when the line guide pivots against the flexible line 3. The ceiling mounted apparatus according to claim 1 wherein the line locking mechanism is a plate with an annular opening, the annular opening having a single notch to engage a knot in the flexible line when the attendant releases the second end of the flexible line, but the annular opening being sufficiently large to freely allow movement of the flexible line through the opening when the attendant holds the second end of the flexible line.

4. The ceiling mounted apparatus according to claim 1 wherein the line locking mechanism has a cylindrically shaped pivotably mounted line guide lock on a first end and a pulley at a second end, the line guide lock having an inner channel co-axial with the line in a free moving mode, the line guide lock having a flat end distal from a pivot end, the flat end compressing the line against a floor of the locking mechanism when the line is locked against movement.

5. A ceiling mounted apparatus for supporting an invalid person comprising a "H" frame bolted to a ceiling, a horizontal portion of the "H" frame attached to multiple fixed brackets, each bracket supporting a pulley, each pulley descending downwardly from the "H" frame, a downwardly descending triangular brace attached to the horizontal portion of the "H" frame supporting a line locking mechanism, a continuous line of sufficient strength to support an invalid patient located through the line locking mechanism and the pulleys to attach at a first end to a patient harness and at a second end to a guide element, the line locking mechanism allowing the line to pass freely when a portion of the line proximal to the second end is pulled by an attendant, but holding the line in place when the attendant releases the line while a patient is supported by the harness at the first end of the line.

* * * * *